US009562412B2

(12) United States Patent
Carrascal et al.

(10) Patent No.: US 9,562,412 B2
(45) Date of Patent: Feb. 7, 2017

(54) DETACHABLE CAPPING DEVICE AND METHOD FOR AN OIL/GAS WELL UNDER BLOWOUT CONDITIONS

(71) Applicants: Jorge Fernando Carrascal, Houston, TX (US); Liliana Carrascal, Bucaramanga (CO)

(72) Inventors: Jorge Fernando Carrascal, Houston, TX (US); Liliana Carrascal, Bucaramanga (CO)

( * ) Notice: Subject to any disclaimer, the term of this patent is extended or adjusted under 35 U.S.C. 154(b) by 0 days.

(21) Appl. No.: 14/474,094

(22) Filed: Aug. 30, 2014

(65) Prior Publication Data

US 2015/0090461 A1 Apr. 2, 2015

Related U.S. Application Data

(63) Continuation-in-part of application No. PCT/IB2013/000500, filed on Jan. 28, 2013.

(51) Int. Cl.

| | |
|---|---|
| ***E21B 33/06*** | (2006.01) |
| ***E21B 33/064*** | (2006.01) |
| ***E21B 34/04*** | (2006.01) |
| ***E21B 41/00*** | (2006.01) |
| ***E21B 36/04*** | (2006.01) |

(52) U.S. Cl.

CPC ..... *E21B 33/064* (2013.01); *E21B 33/062* (2013.01); *E21B 34/04* (2013.01); *E21B 36/04* (2013.01); *E21B 41/0085* (2013.01)

(58) Field of Classification Search

CPC ..... E21B 33/064; E21B 43/0122

USPC ..... 166/363, 368

See application file for complete search history.

(56) References Cited

U.S. PATENT DOCUMENTS

| | | | | | |
|---|---|---|---|---|---|
| 1,520,288 | A | * | 12/1924 | Featherstone | E21B 35/00 166/79.1 |
| 2,532,341 | A | * | 12/1950 | Shannon | E21B 33/037 166/96.1 |
| 3,556,218 | A | * | 1/1971 | Talley, Jr. | E21B 33/035 166/265 |
| 3,813,887 | A | * | 6/1974 | Kruger | B63C 7/006 114/51 |
| 4,323,118 | A | * | 4/1982 | Bergmann | E21B 33/02 166/356 |
| 4,336,843 | A | * | 6/1982 | Petty | A62C 3/02 166/344 |
| 4,531,860 | A | * | 7/1985 | Barnett | E21B 43/0122 210/923 |
| 5,050,680 | A | * | 9/1991 | Diehl | E21B 33/037 137/312 |
| 5,113,948 | A | * | 5/1992 | Richardson | A62C 3/06 169/49 |
| 5,150,751 | A | * | 9/1992 | Burton | E21B 33/08 166/81.1 |

(Continued)

*Primary Examiner* — Matthew R Buck
*Assistant Examiner* — Aaron Lembo

(57) ABSTRACT

Offshore and onshore oil well blowouts can bring serious environmental damages which can cause serious economic loses. Oil wells under blowout conditions can be gushing fluids for months before the well is capped and plugged. Placing a capping device on the top of the well head can be challenged. In this paper it is presented a detachable capping device and a method that will help to control the well, or to plug it. The gushing fluids will be redirect through pipe to a surface vessel where they will be collected.

2 Claims, 4 Drawing Sheets

(56) References Cited

U.S. PATENT DOCUMENTS

| | | | | |
|---|---|---|---|---|
| 5,394,939 | A * | 3/1995 | Walker | E21B 33/08 166/81.1 |
| 6,998,724 | B2 * | 2/2006 | Johansen | E21B 33/0355 166/65.1 |
| 8,025,103 | B1 * | 9/2011 | Wolinsky | E21B 43/0122 166/356 |
| 8,033,328 | B2 * | 10/2011 | Hall | E21B 41/0085 166/65.1 |
| 8,186,443 | B2 * | 5/2012 | Wolinsky | E21B 43/0122 166/356 |
| 8,196,665 | B2 * | 6/2012 | Wolinsky | E21B 43/0122 166/356 |
| 8,322,437 | B2 * | 12/2012 | Brey | E21B 33/035 166/344 |
| 8,789,607 | B2 * | 7/2014 | Jelsma | E21B 43/0122 166/363 |
| 8,887,812 | B2 * | 11/2014 | Caldwell | E21B 43/0122 166/338 |
| 9,074,452 | B2 * | 7/2015 | Andrea | E21B 33/076 |
| 9,085,950 | B2 * | 7/2015 | Spacek | E21B 29/007 |
| 2011/0274493 | A1 * | 11/2011 | Cutts | E21B 43/0122 405/60 |
| 2011/0315395 | A1 * | 12/2011 | Wolinsky | E21B 43/0122 166/363 |
| 2011/0315396 | A1 * | 12/2011 | Wolinsky | E21B 43/0122 166/363 |
| 2012/0024535 | A1 * | 2/2012 | Lieske, II | E21B 43/0122 166/363 |
| 2012/0186822 | A1 * | 7/2012 | Mahajan | E21B 43/0122 166/364 |
| 2013/0008665 | A1 * | 1/2013 | Jelsma | E21B 43/0122 166/363 |
| 2015/0090461 | A1 * | 4/2015 | Carrascal | E21B 33/064 166/363 |

* cited by examiner

DETACHABLE CAPPING DEVICE AND METHOD FOR AN OIL/GAS WELL UNDER BLOWOUT CONDITIONS

This application is a continuation in part of PCT/IB 2013/000500

SPECIFICATION

Background of the Invention

Offshore and onshore oil well blowouts are a mayor concern for the oil industry. When they happen, in addition to the losses of lives, the oil spills can bring humongous environmental damages which disturb the normal habitat of many animals as well as the local economies of nearby towns.

To plug a well that is gushing can take several months. It can be done with the help of drilling a relief well. Capping a well with a device that has not any relief of pressure might compromise the well integrity. Even if the casing is strong enough to hold the pressure at the surface of the well, a fracture at the casing shoe can happen. This fracture can go up to the surface and produce seeps.

Trying to place a capping device on the well head is not an easy task if the well is gushing with high pressure. The present paper presents a new capping devise that will be easy to install and that can help to minimize the oil/gas pollution and keeps the well integrity. In addition, it teaches how to take control of the well or to plug it. Placing a capping device on the top of an oil/gas well that is under blowout conditions is extremely difficult due to the high pressure of the well which will push away anything that gets closer to the plume. A solution to this problem is to place a detachable capping device that will embrace the well head through the sides, so, the plume will not interfere with the installation of it.

In previous art, there are some capping devices that are detachable; however, they need a riser or a conductor pipe where they can be attached. The one presented here does not need it. It can be attached to a flange if needed, or it can be clamped in any place of the wellhead. If the capping device is non detachable, the problem is that the fume will push it away and it will be extremely difficult to attach it in the well that is under blowout conditions. Even though the solution is simple, it is not obvious. The proof is there are many companies investigating this problem and none one has come with this approach. After the oil spill in the Gulf of Mexico in year 2010, at least two capping devices have been designed by some major oil companies in conjunction with blowout preventers manufacturing companies. The designs are not detachable and the designs do not present a capping device that will not be disturbed by the fume. So, to the present, the designed capping devices for a well that is under blowout conditions have different problems. If a capping device is detachable, it does not offer any pressure relief, or if it does offer a pressure relief, it may be extremely difficult to cap due to the closing mechanism. In addition, none of the capping devices searched in the literature offer the chance to recover the oil gas/well. The capping device presented here is detachable, shows an easy way to cap the gushing oil/gas well, keeps the well integrity by offering a relief mechanism, and offers a chance to recover the well. It also can be used in offshore and onshore operations. It can connect to the wellhead using standard flange connection, or, using a couple of lower sealing blocks that will fit the external profile of the place where they will be clamped.

U.S. Pat. No. 1,249,167 by Michigan reveals how to place the base of a capping device alongside the riser. In the absence of a riser or conductor pipe, this method will not work. In addition, even though this method uses split clamps that are attached alongside the riser, the capping (nipple that can have a valve, T, elbow, etc.) device is not split or detachable and at the moment that it can be tried to be screwed on the top of the base, the high pressure from the plume of the well that is gushing will take it aside. So, it will have the same problem that any cap that is already preassembled and is not detachable in two housing members.

Lite Teed et al. U.S. Pat. No. 1,807,498 discloses a capping device with the top as a T which has pipes going up and to the sides. The pipe that goes up does not get inside of the well. This capping design might be good for collecting oil/gas, but not to plug the well, or try to have some control over the well.

U.S. Pat. No. 3,820,601 by Walker, Jr. et al. discloses a capping device which need a riser or conductor pipe to be installed. Without it, it will not work. It presents a similar way to be attached to the casing as U.S. Pat. No. 1,249,167. The difference is that this capping device will cut the upper place of the conductor pipe and will replace it with a plate that will seal the upper section. This capping device can compromise the well integrity if the downhole pressure is too high. In addition, it does not present a way to try to lower a service string to kill the well. This device is intended to shut down the well and it does not offer any relief mechanism.

U.S. Pat. No. 1,786,848 by J. Johnson presents another capping device similar to Walker Jr. et at. In which it is necessary to have a conductor riser or casing in order to installs the device. This one also does not present any relief mechanism and does not allow a string of pipe to kill the well. It also could affect the well integrity.

U.S. Pat. No. 8,540,031 B2 by Rimi presents a tri-flange system having flanges on the top and sides of the housings. This device is detachable. A problem with this design is that when the top flange which has a lid is going to move to a closed position, the flange and the lid have to pass through the plume encountering it from a line of force parallel to the plume and trying to take it to a line of force with an angle perpendicular to the plume. Trying to do this fit is even much more difficult than coming with a pre-assembled heavy weight capping device from the top of the well (with a force direction directly opposite to the force of the plunge). In addition, this device does not offer any change to try to recover the well.

U.S. Pat. No. 2,06,252 by William D. Shaffer and at present a new packing system for blowout preventers or control gates for gas and oil well casing. They provide a gate ram and its packing having sealing efficiency against pipe in the hole. This gate facilitates replacement of that part of the packing which is exposed to the grates wear and tear owing to its engagement with the pipe string to be packet in the casing, and provide for such replacement without the need of changing or discarding of that part of the packing which is extruded against a continues part of the ate shell and not subject to abrasive tear to much extend U.S. Pat. No. 2,090,206 by W. E. King presents a blowout preventer ram that addresses the problem of centralizing a string of pipe inside of the oil/gas well and make a perfect seal against the string of pipe, so, fluids cannot escape between the outside space of the string of pipe and the casing U.S. Pat. No. 3,817,326 by Meyner teaches about a ram type BOP which has a mean to shearing a pipe which may be disposed within its bore and them sealing across the bore.

Carrascal U.S. Pat. No. 8,215,405 B1 builds a filter in order to restrict the flow of fluids out of the well. After the filter is built, he teaches several options to plug the well such as pumping polymers that expand in contact with oil, or pumping cement. These chunks of polymers do not go out of the well due that the filter about them avoids them to get out of the well. The method proposed in the present paper uses heavy metals embedded in expandable polymers in conjunction with a detachable capping device to try to take control of the well.

Other patents of interest are:

Application EP 0159813 A3 by Stephen J. Walker

US20080302536 by Glenn J. Chiasson

U.S. Pat. No. 5,911,284 by Gunther Von Gynz-Rekowski

U.S. Pat. No. 6,527,513 by Kenneth Roderick Stewart at al.

The present paper discloses a capping device that can be used in conjunction of a string of pipe to stop a well blow out once it is happening in matter of short time. This capping device keeps the well integrity. Depending of the physical conditions of the well, it could be possible to recover the gushing well. In case that it might be too difficult to lower a string of pipe to be run into the well, the capping device can be closed on the top and fluids coming from the well can be conducted to surface through a string of pipe that can be connected at the sides of the capping device, or, if a new riser is connected, the fluids can be redirected to surface using the new riser. If pipe can be run in the gushing well, there is change that the well can be recovered using any know well control method.

SUMMARY OF THE INVENTION

When an oil/gas well is under blowout conditions, it can be shut down by closing the Blow Out Preventers, BOPs, if they are working. Assuming this is the case, the well integrity can be compromised. In a similar way, if a capping device is placed on the top of the BOPs, and the capping device does not provide a way to relief the pressure from the well, the well integrity might be compromised at the top of the well head where the casing is weaker for burst pressure, or at the casing shoe where a fracture could be induced. This fracture could be extended to the surface creating seeps on the ocean floor making the problem more difficult to solve. Another way that the oil industry has used to kill a well that is under blowout conditions is to drill a lateral well which will intercept the gushing well somewhere down hole. Once the well has been intercepted, the operation to kill the gushing well can be finalized. This method can take several weeks or months. During this time, the environmental pollution might be humongous.

The present, capping device can be used in conjunction with a string of pipe to take control of the well, or to plug it. If desire to plug the well, a killing string of pipe can be tried to lowered near the bottom of the well and metals, or any material embedded in expandable polymers can be pumped, so, in time, the expandable polymer sensitive to oil, will expand and plug the well. In case that running a string of pipe into the well cannot be possible, the capping device can be closed and the downhole fluids will be directed to surface through pipe, it will provide time for a relief well to be drilled and later plug the well using the relief well.

The capping device is detachable. In this way, it will be easier to be placed on the wellhead compared with a capping device that is already preassembled. Trying to set a capping device that is already preassembled on the top of the BOPs, or at the base of the casing where the BOPs are attached is extremely difficult due to the force from the plume of the well. Because this capping device is detachable, it will be easier to place it on the wellhead. Rather than trying to set the device from the top of the well, the device can be set from the sides where the plume of the well is not interfering with the installation. The base of the detachable capping device can have a flange that splits or it can have the shape or same profile of the place in the BOPs where it is going to be attached, or it can have the outside shape of the casing or riser and be attached there.

The capping device can have one or more chambers. It can also have one or more sealing blocks. This paper will show some options for designing the capping device. One option is a capping device which has only one sealing block, or any suitable valve to stop the flow of fluids to the environment. Also, in the first chamber, there are at least a couple of relief holes that are connected with pipe in order to conduct the down-hole fluids to surface. The housing of the capping device can have any geometrical shape such as a cylindrical shape, cuboidal shape, spheroidal shape, or any desired shape. The same applies for the sealing blocks, as a matter of fact; almost any well-known valve can be used to close the flow of fluids to the environment. For example of a closing mechanism is a ball valve which can be full or a split ball. Pretty much many well-known valves in the market can be used to close the well once the detachable capping device is attached to the any place in the BOPs, or in the casing or riser.

A second chamber can have a couple sealing blocks that may have pipe centralizers which will centralize a string of pipe that will be used to kill, or plug the well. These blocks will seal the space between the casing and the string of pipe that will be used to kill the well. If there is more than one sealing block or valve, the position of which one goes first is dependent of purpose and personal choice. As a matter of fact, if desired, it could be only one chamber with one or many sealing blocks or valves.

If a killer string cannot be run into the oil/gas well because the water depth is too short, or for any other reason, the second chamber can have a ball, or a cuboid, or a cylinder which can be used to close the capping device at the top, allowing fluids to be redirected to surface through pipe that is connected to the lower relief holes in the housing of the device. The sealing block can be moved using hydraulic cylinders or a threaded rod, or it can be done by any mechanical means. Another way to close the capping device is to use a flip flap valve with a closing mechanism that goes from the bottom to the top, so the downhole fluids will close the valve. Once the flap valve is activated to be moved by the downhole fluids to closed position, it will close violently. If a flap valve with closing mechanism that goes from the top to the bottom is used, it will be extremely difficult to close the valve. Another design could be to clamp the two half housings that have relief holes which are connected to pipe for redirection of fluids to surface on any suitable place in the BOPs and try to put a plug on the top of the capping device.

For wells that have problems with paraffin some of the energy of the gushing fluids in the oil/gas well can be used with a turbine to generate electricity in order to warm the capping device and avoid plugging of the gushing fluids inside the relief pipes in the capping device, or to generate electricity to operate valves in the capping device.

DETAILED DESCRIPTION OF THE INVENTION

Figure 1:
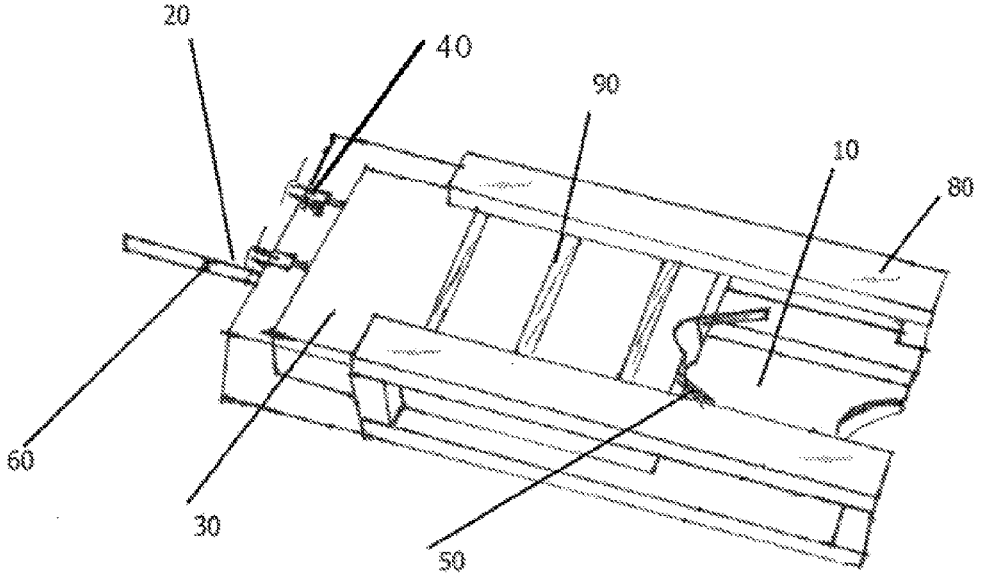
FIG. 1 is a perspective view of half housing member for a detachable capping device.

In offshore operations when a high pressure oil/gas well is under blowout conditions, thousands of barrels of oil are poured into the ocean or into the lake where the well is gushing, in onshore operations the spill can pollute big areas and go to rivers. Trying to place a capping device on the wellhead is an extreme difficult task. The reason is that the high pressure of the plume will push out any capping device that is already preassembled. In addition, placing a capping device that does not offer any relief of fluids can cause the underground casing to fail or the formation to be fractured bringing as a consequence damaging the well integrity. The capping device can be used in conjunction of drilling pipe to try to take control of the well. Drilling pipe alone cannot do it. If there is not any device to choke the fluids from the well, any pumping of heavy fluids will be doing no too much to bring the well under control. The heavy fluids pumped will be taking up by the oil and gas that are coming from the pay zone. In normal drilling or workover operations when a kick is taken, the well control is done by pumping heavy fluids and choking the well. Usually this can be done because there are still some of the heavy fluids used to control the well still in it. When the well is already gushing at high pressure there is nothing of the original heavy fluids used to control the well on it, in addition, if there was pipe in the well, it could have been taking out by the gushing fluids. To try to take control of the oil/gas well under these new circumstances is extremely difficult. If pipe is in the well, pumping heavy fluids and chocking the well offer the chance to take control of the situation. If it is not possible, as an improvement of the traditional petroleum engineering methods to take control of the well is to try to pump embedding heavy metals into expandable polymers sensitive to oil or water, follow by pumping heavy fluids and choking the oil/gas well. When the well is chucked the free flow of underground fluids is restricted, in this way, if heavy metals that are embedded in expandable polymers sensitive to oil might go down to the bottom of the well. In time, the expandable polymer will expand and plug the bottom of the well. In case that some of these chunks of polymers try to go to back to surface, the string of pipe used to control the well can have in the joint that is nearest to the bottom of the whole a way to restrict them to go up. In this way, the downhole pressure starts to be controlled. So, if heavy fluids are pumped and if the well is being choked, there is a possibility to recover the oil/gas well. When there is not pipe in the hole, the capping device can have the option of lowering pipe into the oil/gas well.

It is well known in the oil industry that a killer string alone combined with heavy fluids cannot bring the well under control. It is necessary to have some restriction to the free flow of fluids. This paper is presenting a capping device that will allow taking control over the well or it will help to plug it. This should be done in conjunction with a string of pipe, heavy fluids, and choking the well. Perhaps, as a last resource pumping embedded metals in expandable polymers and choking the well.

FIG. 1 displays half housing member from a detachable capping device which may contain several chambers. Each detachable housing member is similar. The lower chamber 10 has the flange holes that will match the holes of the well head flange or the holes where the riser is attached to the blowout preventer, BOP. Here is where bolts will be placed to secure the housing device to the wellhead. It also contains a relief pipe or hose 20 where the oil/gas coming from the well will be conducted to surface once the moving sealing block 30 is moved to close the scape of downhole fluids to the open water. These sealing blocks are moved by hydraulic cylinders 40. The hydraulic cylinders 40 are dual action. They can be used to move the sealing blocks to open position or to closed position. A threaded rod can also be used to move the sealing blocks instead of the hydraulic cylinders. The design can also be done where block 30 will not have in the center any profile to fit pipe that may be introduced in the hole. A flat sealing block without any profile can cross from one housing member to the other and seal the well. So, only one block will be used to close the well. In this way there is no need of two blocks to close the well. If desired, the two housing member can be connected with a hinge joint. The upper section of the sealing block 30 may have rollers 90 which will facilitate the moving of the block to open or closed position. A valve 60 can be used to control the flow of fluids. The dosing block 30 may have pipe guide 50 to help to centralize pipe that can be run into the hole. The housing can have an electrical resistance 80 that can be used to warm the capping device in order to avoid the formation of paraffin.

The sealing block 30 is connected to the pipe adjuster 50 for hermetic seal once both blocks from each half housing member come into contact. The pipe adjuster will guide the pipe that is run into the hole to the center, where they will fit in the center of the sealing block, so, in that way there will be a hermetic dosing between the blocks and the pipe that might be run into the hole to try to control the blowout. So, the underground fluids will not be able to continue escaping to the open water. If pipe cannot be run into the hole, one of the sealing blocks can be moved from one side of the housing member to the other to close the flow of fluids to the outside environment, or, if the device has more sealing blocks located in different positions they can be moved to close the device.

Figure 2:
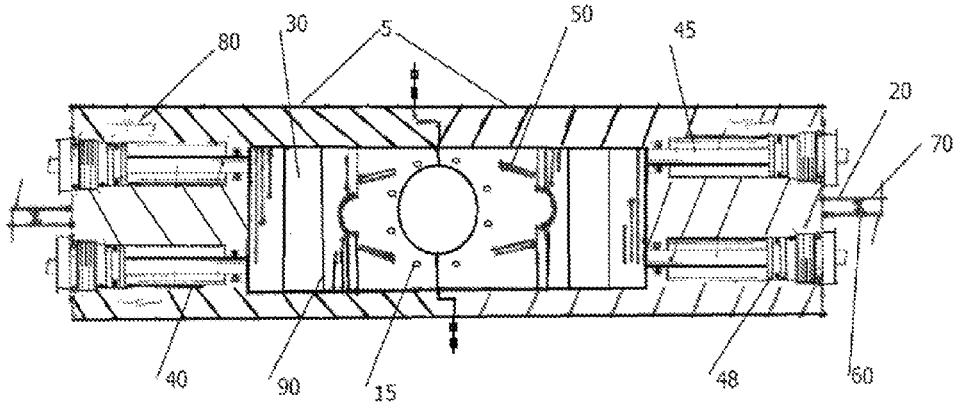
FIG. 2 is a top view of the capping device. Here the two detachable members are together. The moving sealing blocks are in open position.

FIG. 2 shows the two housing members 5 connected. The relief conductor pipe 20 might have a valve 60. The valve 60 can be used to choke the exit of fluids for well control. A turbine or a motor 70 can also be connected to it. The turbine or motor can also be connected in a separated line to the housing as a second relief of fluids. This should be done in each housing member. The energy from the turbine can be used to open or close the valve 60 that will allow fluids to be conducted to surface. It also can be used to create electrical energy to heat the capping device through an embedded electrical resistance 80. For deep water wells, the cold temperatures from the bottom of the ocean can make the paraffin from the underground fluids to get solidified making it to plug the conductor pipe of fluids to the surface. So, hydrate plugs can be formed. To avoid the capping device to be plugged, electrical resistances 80 will be embedded in the capping device and in the choking lines.

The electrical resistances will warm the capping device and the choking lines. Electricity can be provided by external batteries that the Remote Operated Vehicles, ROVs can take into place or by electricity produced by a motor or a turbine that takes advantages of the mechanical energy produced by the flow of downhole fluids. If a motor or a turbine is connected to the relief pipe, a swivel should be connected at the end, and so, a string of pipe that will conduct the downhole fluids to surface can be connected. The capping device will have external outlets for electricity, so, the electrical resistances can be operated.

The moving sealing bock 30 have on the top and on the bottom integrated rollers 90 to help it to move in the housing. Another design could be using a moving cylinder rather than a block. Due to the high downhole pressure, once the moving sealing block 30 touches the downhole fluids, they will try to lift it upwards increasing the friction force between the block and the housing. Without the rollers, the friction force between the sealing block and the housing will require high force to close them, or to open them. Therefore, these rollers will facilitate the movement of the sealing block in the housing reducing the amount of force required to move it inside of it. The hydraulic cylinders 40 have a rod 45 and a piston 48. They are used to move the moving sealing blocks 30. Another option is to use only one moving sealing block instead of two, which will close the upper chamber making the gushing fluids to be redirected to surface through the relief pipes.

Figure 3:
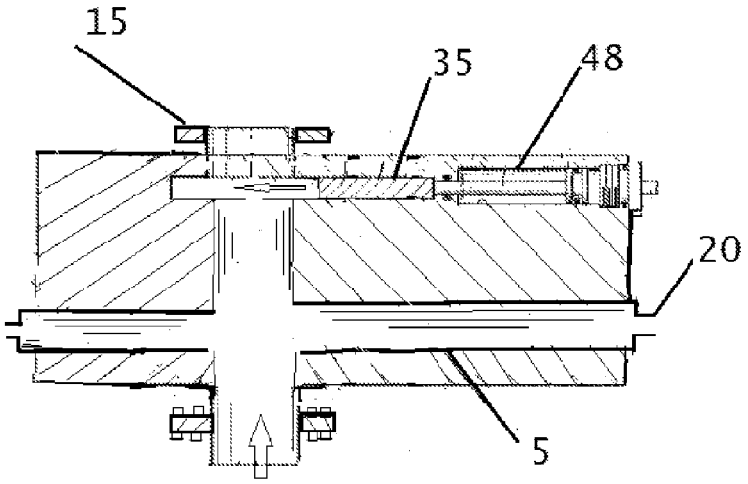
FIG. 3 is a perspective view of half housing member from another option for a similar capping device.

FIG. 3 is a side view of a capping device. Where 35 is an upper sealing block. This sealing block can be replaced by a ball valve, or a flapper valve, or any suitable valve in the market. The upper flange 15 can be used to connect a new riser. The upper sealing block can be moved by a hydraulic cylinder 48, or by any mechanical means such a rod. When the upper sealing block is moved to closed position, the fluids that are coming from downhole will exit through a relief hole 20, which can be connected to a hose or pipe to redirect the fluids to surface. Half housing member 5 is similar to the other half housing member. In this case, the difference is that it contains the upper sealing block.

Figure 4:
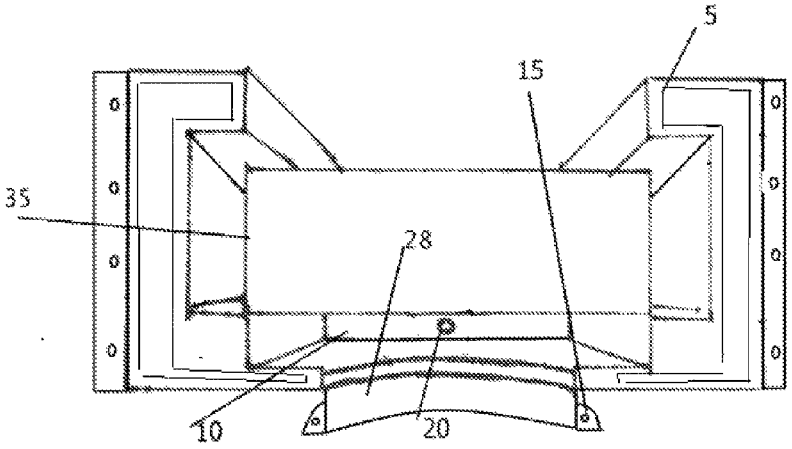
FIG. 4 is a frontal view of half housing of the detachable capping device from FIG. 3

FIG. 4 shows half housing of a capping device which uses only one block 35 that goes from one housing to the other to close the flow of fluids to the outside environment. It is another representation from the capping device from FIG. 3. It can be moved hydraulically or mechanically. A profile 28 can be used to fit the outside side of a BOP, or a casing, or any cylindrical shape where the capping device can be attached. Also, a specific profile can be tailored if need in order to clamp the housing there. There is a relief hole 20 where fluids will be conducted to surface. There is also an option for the device to connect to a flange 15. The rear wall of the device is where the relief hole can be located. Half housing device 5 contains the basic elements of the detachable capping device. Here it is easy to see the lower chamber 10.

Figure 5:
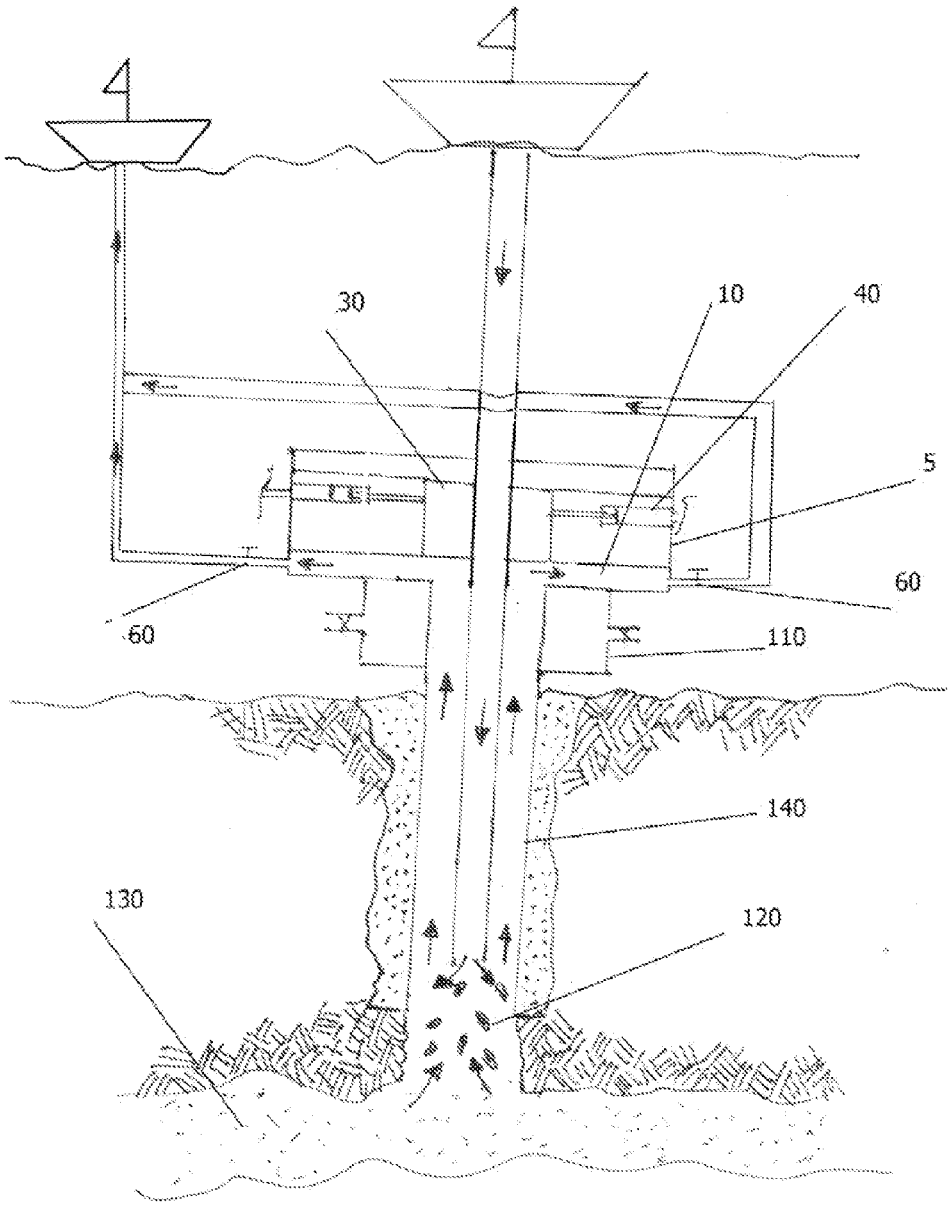
FIG. 5 is an elevational view of the whole system where the capping device is attached to the BOPs, pipe is run into the oil/gas well and heavy metals which are embedded in expandable polymers are pumped into the well. The produced and pumped fluids are collected in surface by a vessel.

FIG. 5 shows how this capping device can be used with conjunction with drilling pipe that is lowered from a drilling ship to try to control the well. The first attempt to control the well should be done by pumping heavy fluids and using any well-known well control method to recover the oil/gas well that is gushing fluids. If this does not work, heavy metals can be embedded in expandable polymers 120. These polymers will be pumped to the bottom of the oil/gas well. Once they are pumped, the well can be choked. Because the free flow of downhole fluids is restricted, the heavy metals that are embedded in the expandable polymer may fall slowly reaching the bottom of the well. The chunks of expandable polymers can have bigger size than the distance between the outer diameter of the drilling pipe and inner diameter of the casing 140, so these chunks cannot go up to the wellhead. Another way to stop some of those chunks of polymers to go back to the wellhead will be placing a kind of restrictor like some welding bars in one of the joints of the pipe. After some time, they will expand and seal the bottom. Right after the polymers are pumped, heavy fluids will be pumped continually. By choking the relief lines in the capping device and pumping heavy fluids, it might be possible to take control of the well. In this FIG. 5 the detachable capping device is attached to the BOPS 110 of the well. The produced fluids from the pay zone 130 as well as the pumped fluids from drilling ship will be conducted to surface where a boat will collect them.

Figure 6:
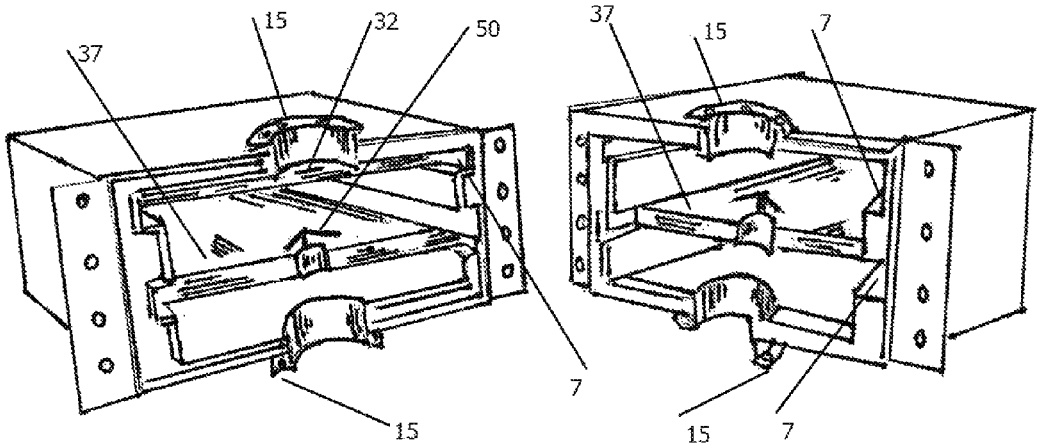
FIG. 6 is an elevational view of a capping device with three sealing blocks.

FIG. 6 shows two housing members with lower 37 and upper 32 sealing blocks. The upper sealing block 32 can move from one side of the housing to the other to seal the well using the guide 7. Under the upper sealing block 32 there are two lower sealing blocks 37. They have a profile to seal a pipe that may be lowered into the oil/gas well.

The procedure to try to take control of the well is as follows: The riser will be removed from the top of the BOPs. If the BOPs fell down, they will be removed. Right after this operation is done, the two housing halves of the capping device will be placed on the flange where the riser was attached to the BOPs, or in the flange where the BOPs where attached, or in any suitable place in the BOP stack. Also, the capping device can have the same shape as any part of the BOP and can be attached to them using the mold shape of them. After this, drilling pipe can be run into the oil/gas well. Once the drilled pipe is run into the hole, the sealing blocks of the capping device can be moved to the closed position. When the sealing blocks move to the closed position, the drilling pipe is centralized and a hermetic seal is done. After the hermetic seal is done, downhole fluids will flow in from the lower chamber to the relief pipes of the capping device. These relief pipes will take the downhole fluids to a surface vessel where they will be collected. These relief pipes have choke valves that are used to choke the oil/gas well. After the pipe is run into the well, it can be controlled by circulating heavy fluids and using any well control method used in the oil industry. If after trying to control the well using circulations of heavy fluids and choking the well cannot be done, heavy metals embedded into oil sensitive expandable polymers can be pumped. Afterward, any well control method can be applied again; methods such The Drillers Method (two circulations); The Wait and Weight (Engineers) method (one circulation), The Concurrent Method, heavy fluids will be pumped and the well can be choked. In time, the expandable polymers will expand and seal the bottom of the well. By pumping heavy fluids and choking the well, little by little the well might be controlled, so, the casing pressure will read zero, if it is not possible due to the high pressure, cement should be pumped, and the oil/gas well should continue to be choked until the cement hardens. The string of pipe that is run into the hole can have an obstruction device that will hold any expandable polymers that might try to go to the well head. If nothing works, relief well can be drilled and in this way, the well can be plugged. If the casing has been burst, a caisson should be tried to be placed in the well and the detachable capping device can be place on it.

Another way to try to control the well is to first move the upper sealing block from the capping device from FIG. 3 to closed position. Fluids will be redirected to surface using the relief pipe connected to the device. After this, a new string of riser can be lowered and attached to the capping device.

Later, a killing string of pipe can lowered inside of the riser. The raiser and the string of pipe can be filled with heavy fluids. The upper sealing block from the capping device can be moved to open position; the killing string of pipe can be tried to be lowered to the bottom of the hole. If the killing string of pipe cannot be lowered into the hole due to high pressure, the upper sealing block can be moved to closed position and relief wells can be drilled in order to take control or the well or to plug from below. If the killing siring is lowered, heavy fluids can be pumped through the killing string and choking the well and any well-known method to kill a well can be used, or, the well can be killed by using back circulation with heavy fluids into the well. For back circulation, it is understood that the heavy fluids will be pumped in the space between the inner wall of the riser or casing and outer wall of the killer string and return to the surface from the inner wall of the killing string.

We claim:

1. A detachable capping device for attachment to an oil/gas well under blowout conditions comprising:

two diametrically opposed housing members configured to attach to one another circumferentially around and in direct contact with a wellhead structure;

wherein the housing members each further comprise a sealing block, a piston and a relief hole, said piston configured to move the sealing block to an open or a closed position to allow or stop the flow of fluids to the outside environment, said relief hole for redirecting fluids from the oil/gas well to the surface;

wherein the wellhead structure comprises a flange in a blowout preventer or to any external part of the blowout preventer or to a flange for a well casing or flange for a riser.

2. A method for controlling a blowout from an oil/gas well with a detachable capping device comprising a housing comprising two diametrically opposed members, a sealing block, a piston, and a relief hole, the method comprising:

placing the housing circumferentially around and in direct contract with a well head structure;

actuating the piston for moving the sealing block to a closed position and redirecting downhole fluids to the surface through the relief hole; or running a killing string into the well and moving the sealing block to the closed position to hermetically seal above the killing string, wherein the killing string is for controlling the blowout from the well;

wherein the wellhead structure comprises a flange in a blowout preventer or to any external part of the blowout preventer or to a flange for a well casing of a flange to a riser.

* * * * *